US010107052B2

(12) United States Patent
Northam et al.

(10) Patent No.: US 10,107,052 B2
(45) Date of Patent: Oct. 23, 2018

(54) CONTROL OF HYDRAULIC POWER FLOWRATE FOR MANAGED PRESSURE DRILLING

(71) Applicant: Weatherford Technology Holdings, LLC, Houston, TX (US)

(72) Inventors: Paul R. Northam, Houston, TX (US); Walter S. Dillard, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 288 days.

(21) Appl. No.: 15/017,418

(22) Filed: Feb. 5, 2016

(65) Prior Publication Data

US 2017/0226813 A1 Aug. 10, 2017

(51) Int. Cl.

| | |
|---|---|
| ***E21B 21/08*** | (2006.01) |
| ***E21B 21/10*** | (2006.01) |
| ***E21B 47/06*** | (2012.01) |

(52) U.S. Cl.

CPC ..... *E21B 21/08* (2013.01); *E21B 21/106* (2013.01); *E21B 47/06* (2013.01)

(58) Field of Classification Search

CPC ..... E21B 21/08; E21B 47/06; E21B 21/106
See application file for complete search history.

(56) References Cited

U.S. PATENT DOCUMENTS

| | | | | |
|---|---|---|---|---|
| 6,920,942 | B2 | 7/2005 | Koederitz | |
| 7,044,237 | B2 | 5/2006 | Leuchtenberg | |
| 7,606,636 | B2 | 10/2009 | Dykstra | |
| 7,636,614 | B2 | 12/2009 | Dykstra | |
| 7,769,493 | B2 | 8/2010 | Elshafei et al. | |
| 8,352,087 | B2 | 1/2013 | Yli-Koski | |
| 8,757,272 | B2 | 6/2014 | Couturier et al. | |
| 2005/0222772 | A1 | 10/2005 | Koederitz | |
| 2011/0094607 | A1 | 4/2011 | Elliott | |
| 2012/0067591 | A1* | 3/2012 | Couturier | E21B 21/08 166/373 |
| 2015/0107898 | A1 | 4/2015 | Leuchtenberg | |
| 2016/0298401 | A1* | 10/2016 | Cotten | E21B 44/00 |

FOREIGN PATENT DOCUMENTS

| | | | |
|---|---|---|---|
| EP | 0 540 079 | B1 | 12/1995 |
| GB | 2 123 983 | A | 2/1984 |
| WO | 2014/007797 | A1 | 1/2014 |

OTHER PUBLICATIONS

Ferguson Enterprises, "ABOUT Cv (Flow Coefficients)," Technical Brochure, copyright 2012, version Mar. 2012.

Int'l Search Report and Written Opinion in counterpart PCT Appl. PCT/US2017/014687, dated Apr. 11, 2017, 11-pgs.

* cited by examiner

*Primary Examiner* — Brad Harcourt
(74) *Attorney, Agent, or Firm* — Blank Rome LLP

(57) ABSTRACT

An assembly uses a choke to control flow of wellbore fluid in a drilling system. A controller operatively coupled to the choke can control opening/closing of the choke with hydraulic power and an actuator. The control operates the opening/closing of the choke with a choke control value to control a parameter in the drilling system, such as pressure or flow. The control measure a time for the choke to at least reach a position toward a full open/closed position during a full opening/closing operation and calculates a current opening/closing speed of the choke. When this current speed is compared to a previously stored speed, the control adjusts the choke control value for the choke based on any difference.

21 Claims, 6 Drawing Sheets

CONTROL OF HYDRAULIC POWER FLOWRATE FOR MANAGED PRESSURE DRILLING

FIELD OF THE DISCLOSURE

The disclosure relates to a method and apparatus to control hydraulic chokes in a managed pressure drilling system.

BACKGROUND OF THE DISCLOSURE

Several controlled pressure drilling techniques are used to drill wellbores with a closed-loop drilling system. In general, controlled pressure drilling includes managed pressure drilling (MPD), underbalanced drilling (UBD), and air drilling (AD) operations.

In the Managed Pressure Drilling (MPD) technique, the drilling system uses a closed and pressurizable mud-return system, a rotating control device (RCD), and a choke manifold to control the wellbore pressure during drilling. The various MPD techniques used in the industry allow operators to drill successfully in conditions where conventional technology simply will not work by allowing operators to manage the pressure in a controlled fashion during drilling.

During drilling, for example, the bit drills through a formation, and pores become exposed and opened. As a result, formation fluids (i.e., gas) can mix with the drilling mud. The drilling system then pumps this gas, drilling mud, and the formation cuttings back to the surface. As the gas rises up the borehole in an open system, the gas expands and hydrostatic pressure decreases, meaning more gas from the formation may be able to enter the wellbore. If the hydrostatic pressure is less than the formation pressure, then even more gas can enter the wellbore.

A core function of managed pressure drilling attempts to control kicks or influxes of fluids as described above. This can be achieved using an automated choke response in a closed and pressurized circulating system made possible by the rotating control device. A control system controls the chokes with an automated response by monitoring flow in and out of the well, and software algorithms in the control system seek to maintain a mass flow balance. If a deviation from mass balance is identified, the control system initiates an automated choke response that changes the well's annular pressure profile and thereby changes the wellbore's equivalent mud weight. This automated capability of the control system allows the system to perform dynamic well control or CBHP techniques.

The chokes of the manifold have a non-linear response. This can make it difficult to determine the true position of the chokes and properly control pressure and flow as conditions change. Additionally, hydraulic power is typically supplied remotely to the chokes by a hydraulic power unit (HPU). Typically, the power unit has a hydraulic pump, an accumulator, and a directional control valve (which can be solenoid-activated). During managed pressure drilling, the solenoid valve is driven by a feedback control loop that uses position measurements of the choke's piston. In the early morning hours of operation, the temperature inside the accumulator and unit's hydraulic reservoir reaches the lowest point of the day. With this low temperature, the nitrogen gas energy in the accumulator is low, and the viscosity of the hydraulic fluid us high. The lower internal Nitrogen pressure of the accumulator allows more hydraulic fluid to enter the accumulator while reaching the set hydraulic system pressure.

Having a greater percentage of hydraulic fluid and less energized gas in the accumulator reduces the velocity of hydraulic fluid leaving the accumulator. Consequently, the morning fluid flowrate that drives the choke is slower, and the response of the choke appears more sluggish than it would at hotter times of the day, when accumulator pressure rises and viscosity drops. The daily temperature cycle causes the MPD system to behave differently depending on the time of day. Another factor that changes hydraulic fluid temperature is the average work load over time. For example, when the MPD system is opening/closing the chokes more frequently, the hydraulic fluid temperature will rise.

Unfortunately, operators are typically trained to use the equipment at a certain operating temperature. Therefore, the operators may tend to find that there is a different and unexpected behavior at another temperature. In particular, the set control variables suited for lower temperatures will cause the choke response to be faster in the afternoon due to the increased Nitrogen energy in the accumulator bottle and the lower viscosity of the hydraulic fluid. This increases the chances of overshooting the target choke position. In fact, choke opening and closing times may vary by around 30% throughout the day, or even depending on whether the equipment is in shade or direct sunlight. Likewise, the set control variables suited for higher temperatures will cause the choke response to be slower to reach set point values as operations continues into the night and morning hours, as a cold front suddenly drops temperatures, etc.

There is a needle valve located in the hydraulic power unit that is used to throttle the flow leading up to the chokes. The needle valve is meant to be set to a position that will allow an optimal flowrate to drive the chokes. Usually, the needle valve is set at the beginning of a job or during a factory acceptance test.

It is recognized that electric actuation of the chokes may have faster response times (i.e., closing and opening times for the chokes) when compared to hydraulic actuation. However, electric actuation on the drilling rig may not be desirable or even possible for various reasons so that hydraulic actuation may be preferred. Therefore, what is needed is a way to mitigate any timing differences that may occur in the choke response in a choke manifold for a drilling system as temperatures change. Therefore, the subject matter of the present disclosure is directed to overcoming, or at least reducing the effects of, one or more of the problems set forth above.

SUMMARY OF THE DISCLOSURE

According to the present disclosure, drilling a wellbore with a drilling system having at least one choke involves controlling a parameter in the drilling system using the at least one choke by operating opening/closing of the at least one choke with at least one choke control value. An opening/closing speed is stored of the at least one choke. During an opening/closing operation, such as toward a full open/closed position, a time is measured for the at least one choke to at least reach a position toward the full open/closed position. Based on the measured time and travel of the at least one choke to reach the position, a current opening/closing speed of the at least one choke is calculated. The at least one choke control value for the at least one choke is then adjusted based on the current opening/closing speed differing from the stored opening/closing speed.

The parameter controlled in the drilling system using the at least one choke can be surface back pressure in the wellbore, flow rate of drilling fluid out of the wellbore, pressure during a drillpipe connection while drilling with the drilling system, pressure during a loss detected while drilling with the drilling system, and flow during a kick detected while drilling with the drilling system. Other parameters could likewise be controlled.

The adjustment of the at least one choke control value may depend on the current opening/closing speed differing from the stored opening/closing speed at least by some threshold determined experimentally or theoretically. The stored speed may then be replaced with the current speed. Depending the form of control used, the adjustment of the at least one choke control value can be made to a proportional-integral-derivative control for the at least one choke.

In the process, the opening/closing operation of the at least choke can be initiated toward a full open/closed position. The initiation can come from receiving a manual or an automatic initiation of the full opening/closing operation. In initiating the full opening/closing operation, a solenoid valve feeding hydraulic fluid to an actuator of the at least one choke can be held fully open/closed.

In measuring the time for the at least one choke to at least reach the position, a time can be measured for the at least one choke in a full opening operation to reach a position of approximately 95 percent open. Likewise, a time can be measured for the at least one choke in a full closing operation to reach a position of approximately 5 percent opened (i.e., 95 percent closed).

To calculate the current opening speed of the at least one choke based on the measured first time to at least reach the first position, travel of the at least one choke from a current position to the first position is determined. Then, the speed is calculated by dividing the determined travel by the first time for the current opening speed.

As will be appreciated, a managed pressure drilling (MPD) system that uses a choke to control a parameter requires consistent and precise control over the choke position. The teachings of the present disclosure address changes in choke speed caused by changes in fluid temperature, which improves choke positional control and provides the MPD system with better pressure control.

According to the present disclosure, an assembly is used with a remote source of hydraulic power to control flow of wellbore fluid in a drilling system. The assembly comprises at least one choke, at least one hydraulic actuator, and a controller. The at least one choke is operable to control the flow of the wellbore fluid to other portions of the drilling system. The at least one hydraulic actuator is disposed with the at least one choke and actuates operation of the at least one choke in response to the hydraulic power. For its part, the controller is operatively coupled to the at least one hydraulic actuator. The controller controls supply of the hydraulic power from the remote source to the at least one hydraulic actuator and controls opening/closing of the at least one choke therewith. The controller is configured to: operate opening/closing of the at least one choke; store opening/closing speeds of the at least one choke; measure a time for the at least one choke to at least reach a position toward a full open/closed position during a full opening/closing operation; calculate a current opening/closing speed of the at least one choke based on the measured time to at least reach the position; and adjust the at least one choke control value for the at least one choke based on the current opening/closing speed differing from the stored opening/closing speed.

According to the present disclosure, a control of at least one choke is used in a drilling system for drilling a wellbore. The control comprises storage storing an opening/closing speed of the at least one choke and storing at least one choke control value for operating the at least one choke. The control also comprises a programmable control device operatively coupled to the storage and to the at least one choke. The programmable control device being operable to: operate opening/closing of the at least one choke with the at least one choke control value; measure a time for the at least one choke to at least reach a position toward a full open/closed position during a full opening/closing operation; calculate a current opening/closing speed of the at least one choke based on the measured time to at least reach the position; and adjust the at least one choke control value for the at least one choke based on the current opening/closing speed differing from the stored opening/closing speed.

The foregoing summary is not intended to summarize each potential embodiment or every aspect of the present disclosure.

DETAILED DESCRIPTION OF THE DISCLOSURE

Systems and methods disclosed herein can be used to control one or more hydraulic chokes in a managed pressure drilling system. Although discussed in this context, the teachings of the present disclosure can apply equally to other types of controlled pressure drilling systems, such as other MPD systems (Pressurized Mud-Cap Drilling, Returns-Flow-Control Drilling, Dual Gradient Drilling, etc.) as well as to Underbalanced Drilling (UBD) systems, as will be appreciated by one skilled in the art having the benefit of the present disclosure.

Figure 1:
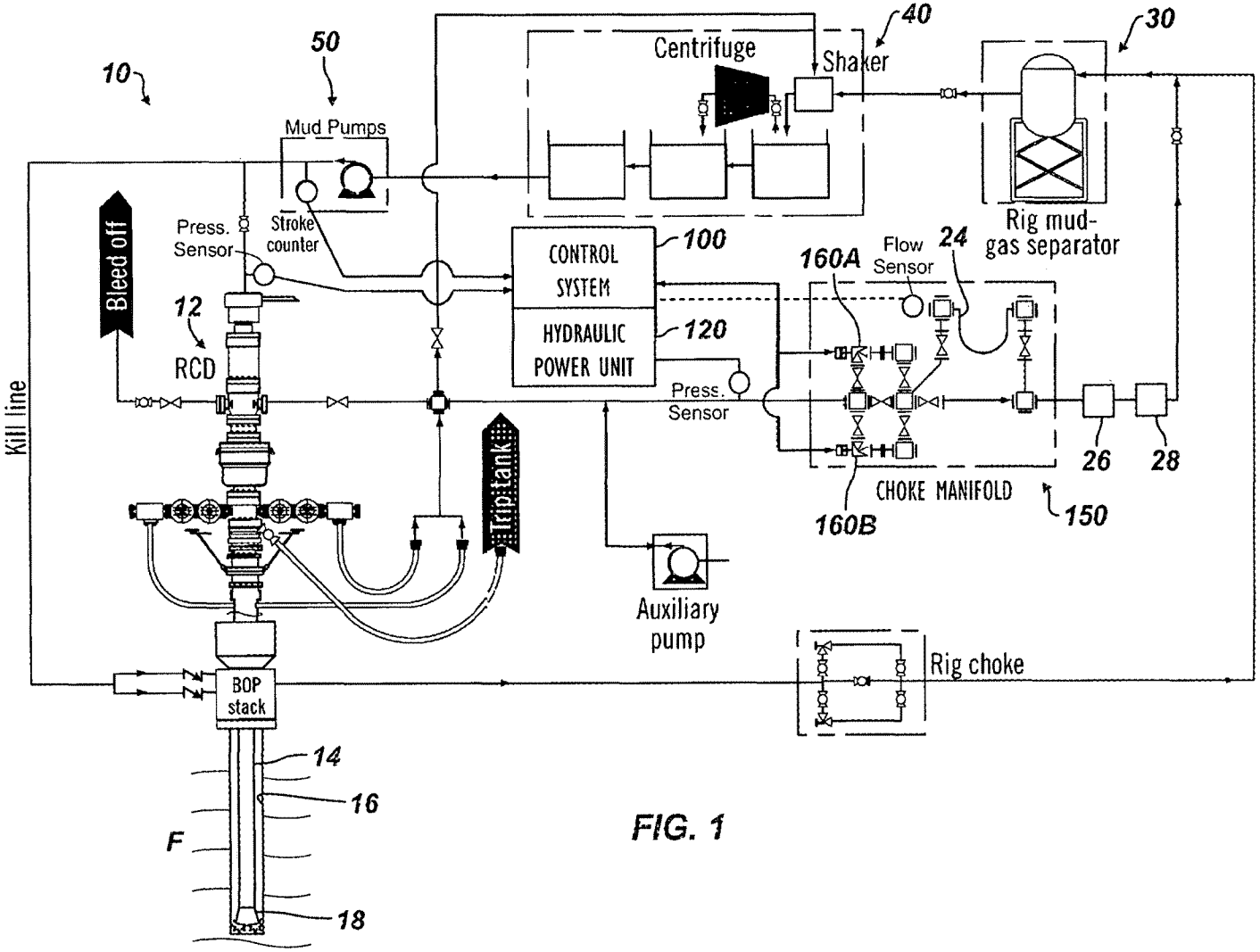
FIG. 1 diagrammatically illustrates a managed pressure drilling system having a choke manifold according to the present disclosure.

FIG. 1 shows a closed-loop drilling system 10 according to the present disclosure for controlled pressure drilling. As shown and discussed herein, this system 10 can be a Managed Pressure Drilling (MPD) system and, more particularly, a Constant Bottomhole Pressure (CBHP) form of MPD system. Although discussed in this context, the teachings of the present disclosure can apply equally to other types of controlled pressure drilling systems, such as other MPD systems (Pressurized Mud-Cap Drilling, Returns-Flow-Control Drilling, Dual Gradient Drilling, etc.) as well as to Underbalanced Drilling (UBD) systems, as will be appreciated by one skilled in the art having the benefit of the present disclosure.

One suitable example of a drilling system 10 is the Secure Drilling™ System available from Weatherford. Details related to such a system are disclosed in U.S. Pat. No. 7,044,237, which is incorporated herein by reference in its entirety.

The drilling system 10 has a rotating control device (RCD) 12 from which a drill string 14, a bottom hole assembly (BHA), and a drill bit 18 extend downhole in a wellbore 16 through a formation F. The rotating control device 12 can include any suitable pressure containment device that keeps the wellbore in a closed-loop at all times while the wellbore 16 is being drilled. The rotating control device (RCD) 12 atop the BOP contains and diverts annular drilling returns. It also completes the circulating system to create the closed loop of incompressible drilling fluid.

The system 10 also includes mud pumps 50, a standpipe (not shown), a mud tank 40, a mud gas separator 30, and various flow lines, as well as other conventional components. In addition to these, the drilling system 10 includes an automated choke manifold 150 that is incorporated into the other components of the system 10.

Finally, a control system 100 of the drilling system 10 is centralized and integrates hardware, software, and applications across the drilling system 10. The centralized control system 100 is used for monitoring, measuring, and controlling parameters in the drilling system 10. In this contained environment of the closed-loop drilling system 10, minute wellbore influxes or losses are detectable at the surface, and the control system 100 can further analyze pressure and flow data to detect kicks, losses, and other events.

The automated choke manifold 150 manages pressure and flow during drilling and is incorporated into the drilling system 10 downstream from the rotating control device 12 and upstream from the gas separator 30. The choke manifold 150 has chokes 160A-B, a mass flow meter 24, pressure sensors, a local controller (not shown) to control operation of the manifold 150, and a hydraulic power unit 120 to actuate the chokes 160A-B. The control system 100 is communicatively coupled to the manifold 150 and has a control panel with a user interface and processing capabilities to monitor and control the manifold 150.

As already noted above, the system 10 uses the rotating control device 12 to keep the well closed to atmospheric conditions. Fluid leaving the wellbore 16 flows through the automated choke manifold 150, which measures return flow and density using the flow meter 24 installed in line with the chokes 160A-B. Software components of the control system 100 then compare the flow rate in and out of the wellbore 16, the injection pressure (or standpipe pressure), the surface backpressure (measured upstream from the drilling chokes 160A-B), the position of the chokes 160A-B, and the mud density. Comparing these variables, the control system 100 identifies minute downhole influxes and losses on a real-time basis to manage the annulus pressure during drilling. All of the monitored information can be displayed for the operator on the control panel of the control system 100.

In the controlled pressure drilling, the control system 100 introduces pressure and flow changes to this incompressible circuit of fluid at the surface to change the annular pressure profile in the wellbore 16. In particular, using the choke manifold 150 to apply surface backpressure within the closed loop, the control system 100 can produce a reciprocal change in bottomhole pressure. In this way, the control system 100 uses real-time flow and pressure data and manipulates the annular backpressure to manage wellbore influxes and losses.

In the managed pressure drilling (MPD) system 10, the control system 100 monitors for any deviations in values during drilling operations, and alerts the operators of any problems that might be caused by a fluid influx into the wellbore 16 from the formation F or a loss of drilling mud into the formation F. To do this, the control system 100 monitors flow into the well for comparison to flow out of the well. Therefore, a pressure sensor and a means for measuring flow are provided for both "flow-in" and "flow-out" of the well 16. For the flow-in, the control system 100 can use the pump stroke counter to determine flow into the well and can use a pressure sensor for the stand pipe pressure (SPP). For the flow-out, the control system 100 can use the Coriolis flow meter 24 or the like on the choke manifold 150 to determine the mass flow out of the well 16 and can use a pressure sensor for the surface back pressure (SBP). In other words, the system 100 uses sensors for mass flow and pressure into and out of the well 16. In this way, the control system 100 can automatically detect, control, and circulate out such influxes by operating the chokes 160A-B on the choke manifold 150.

For example, a possible fluid influx or "kick" can be noted when the "flow out" value (measured from the flow meter 24) deviates from the "flow in" value (measured from the stroke counters of the mud pumps 50). As is known, a "kick" is the entry of formation fluid into the wellbore 16 during drilling operations. The kick occurs because the pressure exerted by the column of drilling fluid is not great enough to overcome the pressure exerted by the fluids in the formation being drilled.

The kick or influx is detected when the well's flow-out is significantly greater than the flow-in for a specified period of time. Additionally, the standpipe pressure (SPP) should not increase beyond a defined maximum allowable SPP increase, and the density-out of fluid out of the well does not drop more than a surface gas density threshold. When an influx or kick is detected, an alert notifies the operator to apply the brake until it is confirmed safe to drill. Meanwhile, no change in the rate of the mud pumps 50 is needed at this stage.

In the control system 100, the kick control can be an automated function that combines kick detection and control, and the control system 100 can base its kick control algorithm on the modified drillers' method to manage kicks. In a form of auto kick control, for example, the control system 100 automatically closes the chokes 160A-B to increase surface backpressure in the wellbore annulus 16 until mass balance is established and the influx stops.

The system 100 adds a predefined amount of pressure as a buffer and circulates the influx out of the well by controlling the stand pipe pressure. The stand pipe pressure will be maintained constant by automatically adjusting the surface backpressure, thereby increasing the downhole circulating pressure and avoiding a secondary influx.

Once the flow-out and flow-in difference is brought under control, the control system 100 will maintain this equilibrium for a specified time before switching to the next mode. In a successful operation, the kick detection and control cycle can be expected to be managed in roughly two minutes. The kick fluid will be moving up in the annulus with full pump speed using a small decreased relative flow rate of about −0.1 gallons per minute to safely bring the formation pressure to balance.

On the other hand, a possible fluid loss can be noted when the "flow in" value (measured from the stroke counters of the pumps 50) is greater than the "flow out" value (measured by the flow meter 24). As is known, fluid loss is the loss of whole drilling fluid, slurry, or treatment fluid containing solid particles into the formation matrix. The resulting buildup of solid material or filter cake may be undesirable, as may be any penetration of filtrate through the formation, in addition to the sudden loss of hydrostatic pressure due to rapid loss of fluid.

Similar steps as those above, but suited for fluid loss, can then be implemented by the control system 100 to manage the pressure and flow during drilling in this situation. Killing the well is attempting to stop the well from flowing or having the ability to flow into the wellbore 16. Kill procedures typically involve circulating reservoir fluids out of the wellbore or pumping higher density mud into the wellbore 16, or both.

In addition to the choke manifold 150, the drilling system 10 can include a continuous flow system (not shown), a gas evaluation device 26, a multi-phase flow meter 28, and other components incorporated into the components of the system 10. The continuous flow system allows flow to be maintained while drillpipe connections are being made, and the drilling system 10 may or may not include such components. For its part, the gas evaluation device 26 can be used for evaluating fluids in the drilling mud, such as evaluating hydrocarbons and other gases or fluids of interest in drilling fluid. The multi-phase flow meter 28 can be installed in the flow line to assist in determining the make-up of the fluid.

As noted above, controlling pressure during drilling essentially requires moving the chokes 160A-B with a control to achieve a necessary amount of pressure or flow according to the purposes of the well control operations governed by the control system 100. Therefore, an element of this automation is a control-loop feedback mechanism that consists of a control tailored to characterize the MPD equipment (e.g., choke actuators) and is capable of adapting to changing dynamics, such as mud systems, well compressibility, drilling windows, and surface equipment limitations.

In the tight pore pressure and fracture gradient windows that can be found in wellbores 16, successful drilling often involves maintaining a predefined pressure at a specific depth in the well. This involves eliminating and minimizing pressure spikes and oscillations that might exceed the drilling window parameters and create a kick-loss event. Drilling under these circumstances commonly requires pressure regimes that are less than 100 psi between the respective gradients.

Figure 2:
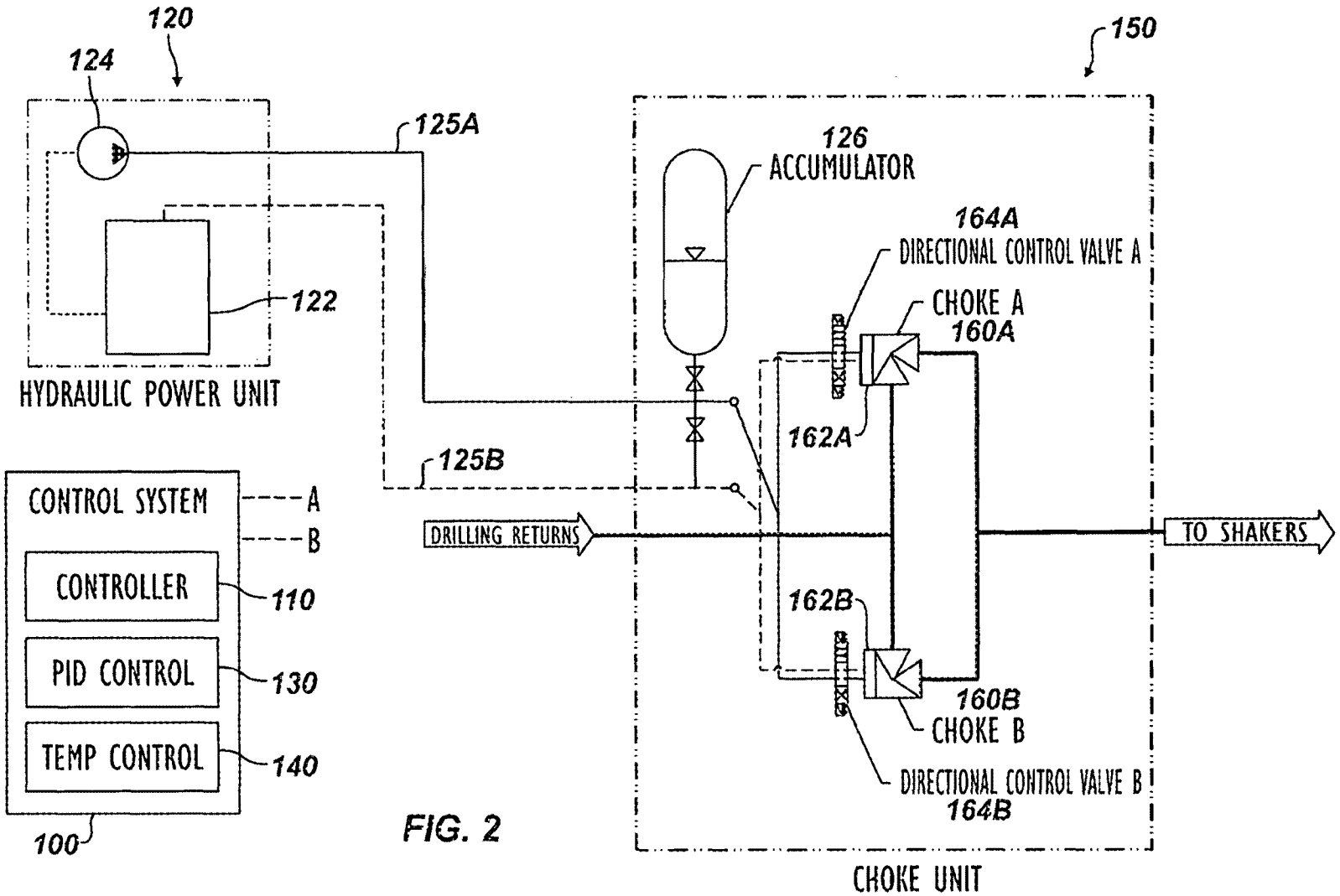
FIG. 2 illustrate features of a hydraulic power unit, a choke manifold, and a control system according to the present disclosure.

As noted above, hydraulic power is typically supplied remotely from the hydraulic power unit 120 to the chokes 160A-B of the system 10. As shown in FIG. 2, the hydraulic power unit 120 includes a hydraulic reservoir 122, one or more hydraulic pumps 124, and necessary piping, fittings and valves. These components can be housed together on a skid or manifold. A supply line 125A from the pumps 124 communicates the hydraulic power to the choke manifold 150 positioned some distance away from the power unit 120. In a similar fashion, a return line 125B from the choke manifold 150 returns the hydraulics to the reservoir 122. Each choke 160A-B is actuated by a hydraulic actuator 162A-B controlled by one of the directional control valves 164A-B connected either directly or remotely to the chokes 160A-B. The independent directional control valves 164A-B are used to mitigate differences in the chokes 160A-B and provide independent feedback control of the chokes 160A-B.

In general, various types of control valves could be used for the system's valves 164A-B, and they can have various states for controlling the chokes 160A-B. For example, the control valves 164A-B can have a first state directing the hydraulic flow to open the respective choke 160A-B, a second state directing the hydraulic flow to close the respective choke 160A-B, and a third state that closes off the hydraulic flow to neither open nor close the respective choke 160A-B. The control valves 164A-B can be operated by a solenoid or the like (not shown) with control signals from control lines A and B of the control system 100, as noted herein. In turn, the hydraulic power directed by the control valves 164A-B operates the respective hydraulic actuators 162A-B for the chokes 160A-B.

In another arrangement, two or more solenoid-operated directional control valves 164A-B with two or more valve positions can be connected either in series or parallel to achieve the three states mentioned above. In this way, the choke open state, closed state, and neither open nor closed state can be achieved with different pairings of positions between the two or more directional control valves.

As shown here in FIG. 2, the control valves 164A-B connected to the supply and return lines 125A-B may be directional and may typically have three states or positions. In a central state (when the solenoid is not activated), the directional control valve 164A-B allows for no flow in either direction. This closes all of the ports for both of the supply and return lines 125A-B so that there is no choke movement. A choke-opening or parallel-flow state (when the solenoid is activated in one direction "A") opens both ports and allows flow from the supply line 125A into to Port A and allows flow out of Port B to the return line 125B. The choke 160A-B in turn is moved toward its open direction. Finally, a choke-closing or cross-flow state (when the solenoid is activated in an opposite direction "B") opens both ports but switches the direction of the flow in each of the ports for the supply and return lines 125A-B. The choke 160A-B in turn is moved toward its close direction.

Use of the hydraulic arrangement in FIG. 2 may improve the choke responses by reducing the differences in the hydraulic lines feeding the chokes 160A-B. To help further compensate for variations of temperature due to seasonal changes or location/longitudinal changes, the unit 120 can use a hydraulic fluid with lower viscosity for use in colder climates and can use a different hydraulic fluid with higher viscosity for use in hotter climates. It may be possible to further reduce the effects of temperature and viscosity changes by using synthetic or other types of hydraulic fluid. Although this may generally acclimate the unit 120 for use in a general temperature range, the control system 100 preferably accounts for effects that finer temperature variations have on the choke response throughout the day as the hydraulic power unit 120 operates the chokes 160A-B.

To help compensate for such finer variations in temperature, the control system 100 uses one or more proportional-integral-derivative (PID) controls 130 that compensate for finer variations in temperature. Additionally, the control system 100 uses one or more temperature-based controls 140 to change the choke response during operations in response to changes in temperature.

At the start of an operation of the drilling system 10, for example, the control system 100 can be calibrated with initial PID controls 130 that are appropriate for operation. The PID controls 130 can be manually adjusted to get the best control response for the system 10. This adjustment may only be permitted once at the beginning of the job due to the length of time it takes to find a sweet spot for the PID controls 130. Although proportional, integral, and derivative gains are discussed, the control 130 used in controlled pressure drilling is typically a proportion-integral type of control.

As noted above, the PID controls 130 control the chokes 160A-B to change pressure or flow in the system 10 in the controlled drilling operations by providing the feedback used to adjust and stabilize wellbore pressure and flow. Even though initially set, the PID controls 130 during normal operation of the system 100, will eventually cause the directional control valves 164A-B and actuators 162A-B to speed up or slow down the choke response while the chokes 160A-B obtain a pressure set point. This change is due in part from temperature changes in the hydraulic fluid, the environment, the manifold 150, hydraulic power unit 120, etc.

Accordingly, the control system 100 monitors the choke's response (i.e., movement, speed, and accuracy) during operations so that the choke's response can be adjusted based on the temperature changes in the hydraulic fluid, the environment, the manifold 150, hydraulic power unit 120, etc.

When managed pressure drilling uses two or more chokes 160A-B in simultaneous operation as shown, the temperatures can be different for the two flow-paths 125A-B depending on construction and the like. This can lead to a different system response between the chokes 160A-B. For example, one hydraulic choke 160A may tend to respond more slowly than the other choke 160B. The control system 100 of the present disclosure can therefore be configured to operate the multiple chokes 160A-B in conjunction with one another while still accounting for differences in their responses due to temperature and the like.

Figure 3A:
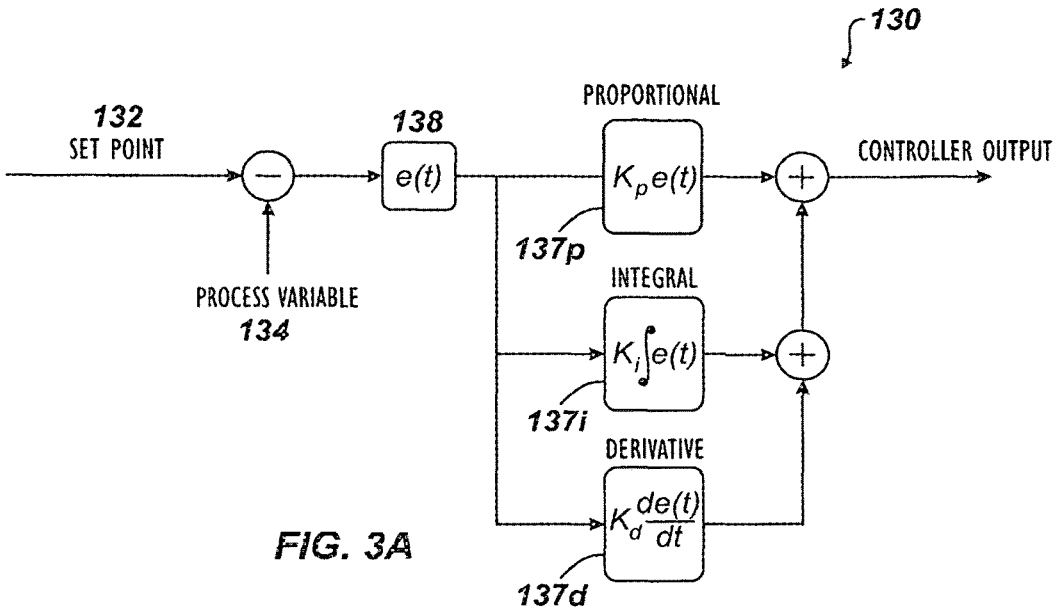
FIG. 3A illustrates a proportional-integral-derivative (PID) control that can be used in the control system.

FIG. 3A illustrates features of the proportional-integral-derivative (PID) control 130 that can be used in the controlled pressure drilling to control a choke 160A-B. In this PID control 130, a process variable 134 (e.g., current surface backpressure in the drilling system 10, current choke position, etc.) is compared to a configured set point 132 to calculate an error 136. That error 136 can then be operated on by one or more of: a proportional gain (Kp) times the magnitude of the error (e(t)) (137*p*), an integral gain (Ki) times the integral of the error (e(t)) (137*i*), and a derivative gain (Kd) times the derivative of the error (e(t)) (137*d*). The one or more of these are then summed together to provide a controller output 138 (e.g., new pressure, new choke position, etc.) for adjusting a control value for hydraulic power unit 120, the directional control valves 164A-B and/or the actuators 162A-B of the choke 160A-B.

In the drilling system 10, for example, the PID control 130 stabilizes wellbore pressure fluctuations by managing pressure quickly in small increments. These increments can be as small as ±1 psi when circulating homogeneous fluid or during pipe connections with the aid of auxiliary flow, or as much as ±10 psi when circulating gas or large cuttings. In other cases such as when tripping in or out with as much as 500-psi of surface pressure, observed increments or decrements in pressure can range from 5 to 20-psi.

Figure 3B:
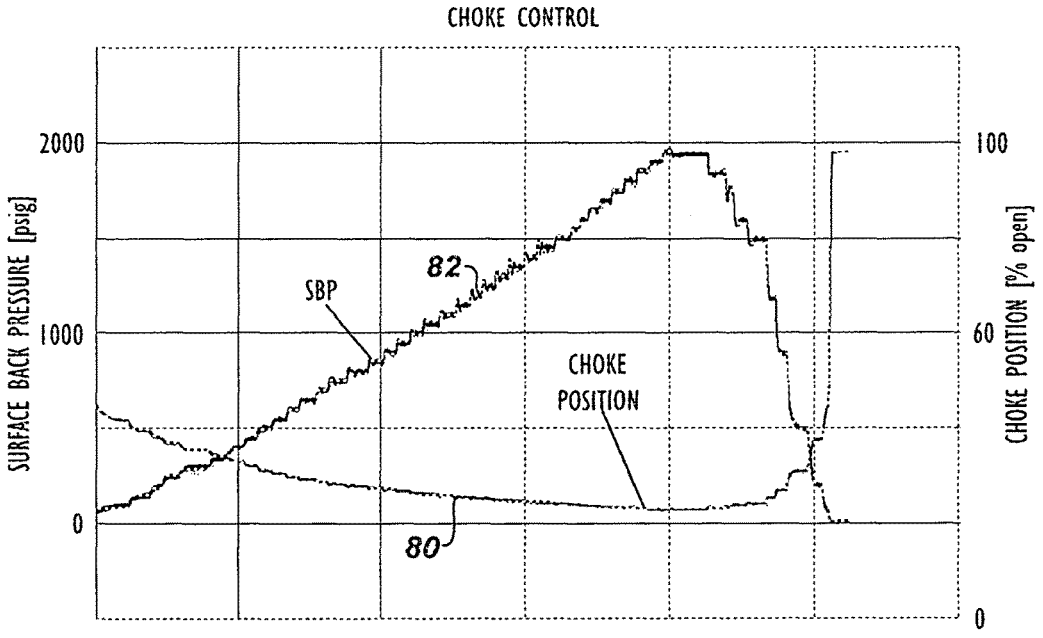
FIG. 3B graphs the PID control of a choke showing the surface backpressure change relative to the controlled choke position.

FIG. 3B graphs how the PID control of choke position 80 functions to control surface backpressure 82. The choke position 80 is adjusted over time with the PID control 130 to affect the surface backpressure 82, which is graphed for comparative purposes. As it appears, the choke position 80 is adjusted closed as the surface backpressure continues to rise and reaches a peak level of almost 2000-psig. A sudden drop in the surface backpressure 82 then follows, and the choke position 80 is rapidly adjusted open.

The control system 100 has various set points defined based on what is anticipated so that the choke position 80 can be controlled to achieve a desired surface backpressure 82. The PID control 130 for the chokes 160A-B in the manifold 150 are configured to control the chokes 160A-B so the system 100 can reach the set points. Depending on temperature and other conditions, however, the existing PID controls 130 may not adjust the chokes 160A-B as needed under certain circumstances for the defined set point to be reached in an appropriate interval.

Accordingly, tuning for the various gains 137*p*, 137*i*, 137*d* of the PID control 130 in FIG. 3A is handled to achieve a desired system response. As will be appreciated, all this handling and tuning of the PID control 130 depends on how the operator sets up the control system 100. Initially, the interface of the control system 100 requires that certain parameters be established, such as set points, pressure and flow differential dead-bands, and time durations desired before the system reacts. According to the present disclosure, feedback of opening/closing speeds of the chokes 160A-B during operation is then used to tune/adjust the PID control 130 of the control system 100. Additionally, data related to temperature is used to tune/adjust the control of the chokes 160A-B.

Figure 4:
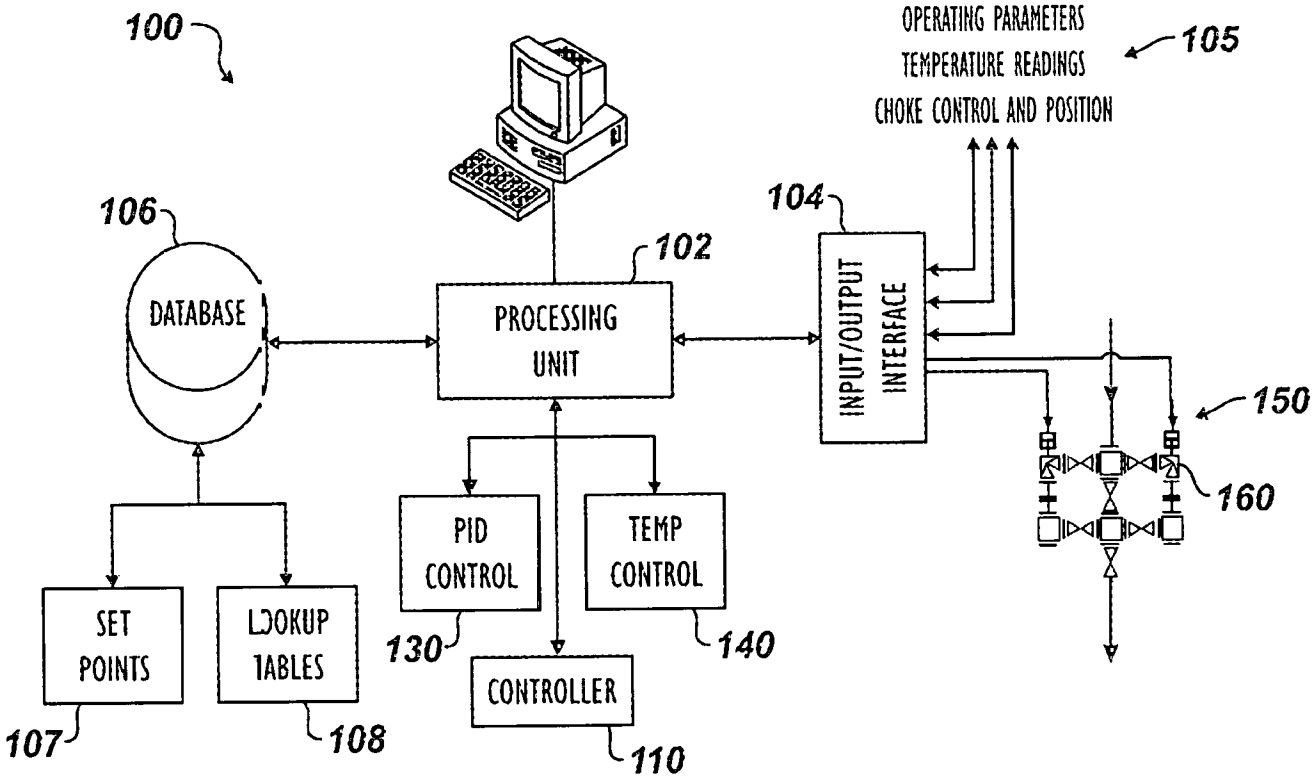
FIG. 4 illustrates a schematic of the disclosed control system.

The control system 100 of the present disclosure, which performs the tuning/adjustment, is schematically shown in FIG. 4. The control system 100 includes a processing unit 102, which can be part of a computer system, a server, a programmable logic controller, etc. Using input/output interfaces 104, the processing unit 102 can communicate with the choke(s) 160A-B and other system components to obtain and send communication, sensor, actuator, and control signals 105 for the various system components as the case may be. In terms of the current controls discussed, the signals can include, but are not limited to, the choke position signals, the hydraulic power unit pressure signals, system pressure signals, system flow signals, temperature signals, fluid density signals, etc.

The processing unit 102 also communicatively couples to a database or storage 106 having set points 107, lookup tables 108, and other stored information. The lookup tables 108 characterize the specifications of the choke, flow coefficient character (e.g., flow coefficient versus choke position), and choke response due to temperature. This information can be defined by the choke's manufacture, through testing of the choke 160A-B, and through periodic calibration of the choke 160A-B. Although lookup tables 108 can be used, it will be appreciated that any other form of curve, function, data set, etc. can be used to store the flow coefficient character. Additionally, multiple lookup tables 108 or the like can be stored and can be characterized based on different chokes, different drilling fluids, different operating conditions, and other scenarios and arrangements.

Finally, the processing unit 102 can operate a choke controller 110 according to the present disclosure for monitoring, tuning, and controlling the choke(s) 160A-B. For example, the processing unit 102 can transmit signals to one or more of the chokes 160A-B of the drilling system using any suitable communication. In general, the signals are indicative of a choke position or position adjustment to be applied to the chokes 160A-B to achieve a desired set point in the MPD operations.

Typically, the chokes 160A-B are controlled by hydraulic power so that electronic signals transmitted by the processing unit 102 may operate solenoids, valves, or the like of a hydraulic power unit 120 for operating the chokes 160A-B. As shown, two chokes 160A-B are typically used in the closed-loop drilling system 10. The same choke control can apply adjustments to both chokes 160A-B or separate choke controls can be used for each choke 160A-B. In fact, the two chokes may have differences that can be accounted for in the two choke controls used.

As will be discussed in more detail below, the control system 100 uses the high-speed choke controller 110 tuned in real-time using PID controls 130, temperature controls 140, among others. A choke position set point (107) is calculated in real-time and applied to a desired position for the choke(s) 160A-B to achieve the purposes of the controlled pressure drilling. In other words, the choke controller 110 uses the PID control 130 and the temperature-based control 140 for tuning/adjusting the control and determining the required adjustment to the current choke position to achieve the desired set point 107. This tuning/adjustment provides the required control response as conditions change and the choke 160A-B operates in its upper or lower ranges of temperature, which can improve performance of the choke manifold 150.

Figure 5:
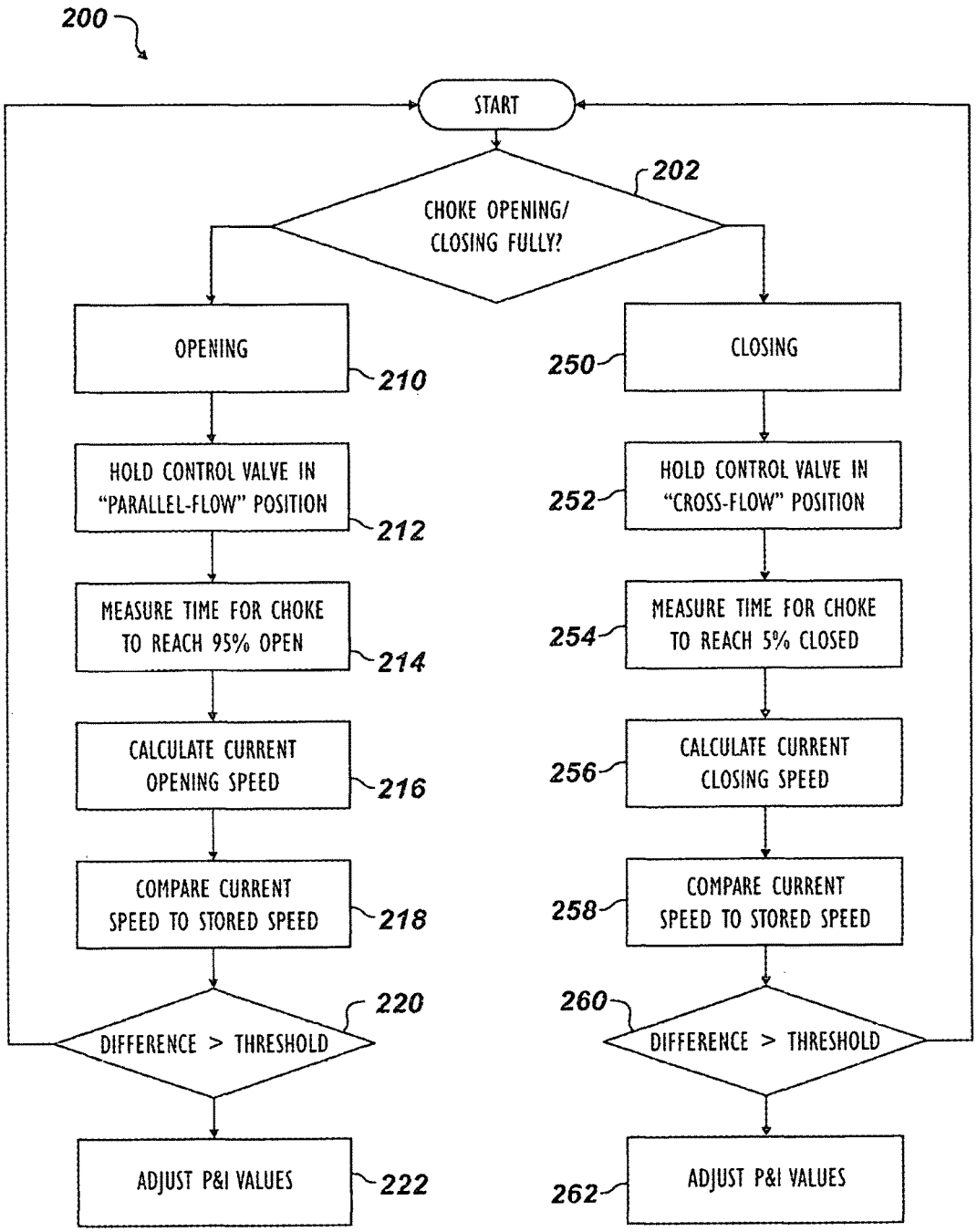
FIG. 5 illustrates a process according to the present disclosure to account for effects to choke response due to changes in temperature.

According to a first embodiment to tune/adjust the control of the choke(s) 160A-B, the control system 100 uses calculations based on the PID controls 130 to handle the disparate operations of the system 10 due to temperature changes over time. FIG. 5 illustrates a process 200 performed by the control system 100 to handle changes in choke response due to temperature changes. In general, the control system 100 measures the choke position over time and calculates an accurate choke speed. This speed is then fed as an input for the control loop of the system 100 and affects the assigned PID variables of the PID control 130 controlling the directional control valves 164A-B and actuators 162A-B for the choke manifold 150 and the hydraulic power unit 120 if possible.

In particular, a number of opportunities may arise during a typical operation that would require the chokes 160A-B to be fully opened or closed. Therefore, the control system 100 can monitor for situations when the chokes 160A-B are to be opened fully or closed fully, such as when an operator manually instructs at a control panel of the system 100 for a choke to operate fully open or closed. Other situations may also arise in which the control system 100 automatically instructs the chokes 160A-B to be opened or closed fully. Whether user-initiated or automatic opening/closing of the chokes 160A-B is involved, the control system 100 can perform an ad hoc calibration of the choke response, which may be affected by current operating temperatures and the like.

Looking at opening steps (Blocks 210-222) when the choke 160A-B begins opening toward full open (e.g., about 100% open), such as when manually or automatically instructed open (Block 210), the directional control valve 164A-B is left wide open (i.e., in its "choke-opening or parallel-flow" state) (Block 212). While the valve 164A-B is left wide open, the control system 100 measures the time for the choke 160A-B to reach at least a portion of a full open position (e.g., approximately 95% open) (Block 214). A variance of a few percentages may be acceptable given an implementation.

The current opening speed of the choke 160A-B is calculated based on the measured time for the choke 160A-B to move from its current position toward a position at least near full open (e.g., about 95% full open) (Block 216). The hydraulic power unit 120 provides the hydraulic power through the open directional control valve 164A-B to the actuator 162A-B of the choke 160A-B. The temperature of the hydraulic fluid as well as the components of the system may affect the choke response.

The current position of the choke 160A-B can be measured using a sensor or the like or may be determined mathematically. The final position at least near open can be comparably measured or determined. A timer in the control system 100 is started at the beginning of the operation and stops once the final near-open position is reached. Travel of the choke 160A-B from the current position to the final position is determined, and a simple calculation then determines the speed at which the choke 160A-B opened by dividing the determined travel by the timer's value.

The control system 100 compares the measured speed at this point in the day's operation to earlier measurements made during other points in the day (Block 218). Based on the comparison (Block 218), the control system 100 adjusts the PID variables of the PID control 130 accordingly to keep the opening speed consistent throughout time (Block 222).

A preliminary determination can be made before adjusting the PID variable to ensure that the difference from the comparison is greater than a given threshold (Decision 220). This may prevent unnecessary changes in the system's operation. In the end, the control system 100 can automatically correct (or may prompt the operator for permission to correct) the PID values of the PID control 130 whenever the choke speed changes beyond a specified threshold (Block 222).

Selection of which gain (proportional, integral, or derivative) to adjust and of how much adjustment to make can be codified in the lookup tables 108 of the control system 100. The factors governing the selection can be determined from historical and experimental data and analysis.

The closing steps (Blocks 250-262) may use a reciprocal set of operations when the choke 160A-B begins closing toward full closed (i.e., about 0% open), such as when manually or automatically instructed closed (Block 250). The directional control valve 164A-B is held in its crossflow state to close the choke (Block 252). While the directional control valve 164A-B closes the choke 160A-B, the control system 100 measures the time for the choke 160A-B to reach at least a portion of a fully closed position (e.g., approximately 5% open) (Block 254). The current closing speed of the choke 160A-B is calculated based on the measurement of the time it takes the choke 160A-B to move from its current position to the portion of the fully closed position (Block 256). Then, the control system 100 compares the measured speed at this point in the day's operation to earlier measurements made during other points in the day (Block 258). Based on the comparison, the control system 100 adjusts the PID variables of the PID control 130 accordingly to keep the closing speed consistent throughout time (Block 262).

Portion of the fully closed choke 160A-B is used as a measurement point because the actual behavior of the choke beyond that point may be problematic. In general, the PID controls 130 may not work well when the choke 160A-B is near its fully closed states when small movements of the choke's components produces larger changes in pressure or flow. Therefore, a portion or position near the fully closed state may be the preferred point at which to make the measurements. Similar reasons can apply to a portion or position near a fully open state of the choke 160A-B because opening beyond that position may have little appreciable difference. As an option, a pressure sensor (not shown) can be tied into the controller 110 to measure changes in pressure associated with the choke 160A-B.

Again, selection of the adjustments to the gains can be made in a manner similar to that noted above. Also, a preliminary determination can be made before adjusting the PID variable to ensure that the difference from the comparison is greater than a threshold (Decision 260). In the end, the control system 100 can automatically correct (or may prompt the operator for permission to correct) the PID values whenever the choke speed changes beyond a specified threshold (Block 262).

Because the choke manifold 150 as disclosed herein can have more than one choke 160A-B, each choke 160A-B can be separately assessed with these process steps. In this way, the PID opening/closing values associated with the PID control 130 for each choke 160A-B can be separately adjusted or not as needed. This is useful because the different chokes 160A-B may have differences that can be accounted for by separate controls.

The solution in FIG. 5 for choke position control can be implemented mainly in software and programming of the control system 100. No extra hardware may be required in the system 100. In additional embodiment, a throttle valve 310 in the HPU 120 can be used to improve choke position control. Also, a temperature sensor and other temperature features can be installed on the HPU 120 to provide temperature feedback as necessary.

Figure 6:
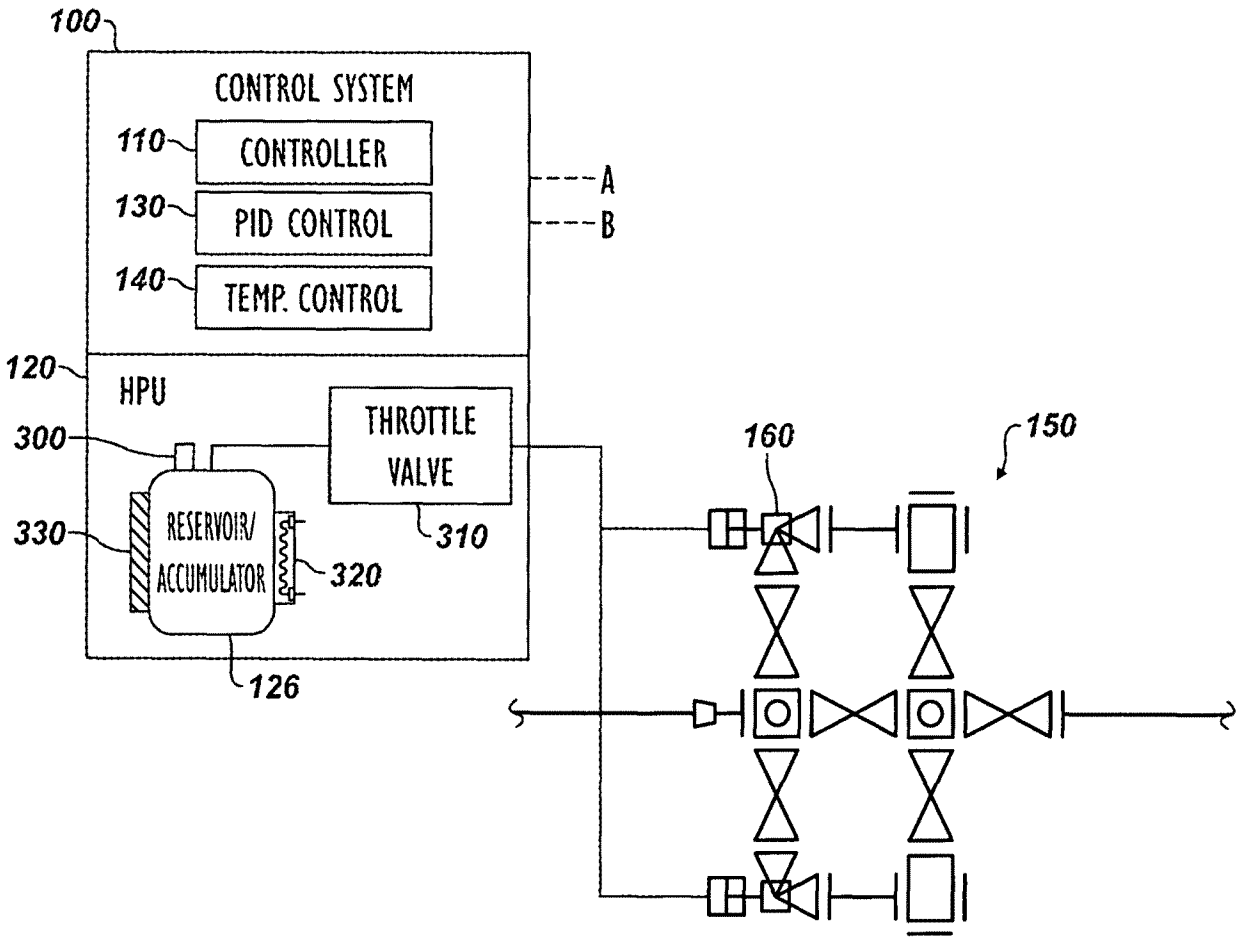
FIG. 6 illustrates a schematic of the disclosed control system to account for effects to choke response due to changes in temperature.

As shown in FIG. 6, for example, the control system 100 can use a temperature sensor 300 to measure temperature information for improving control over the choke position while hydraulic fluid temperature changes. The sensor 300 can monitor the temperatures of the hydraulic fluid of the system 120. Feedback of the temperature in the control system 100 can then be used to tune/adjust the controls signals to the chokes 160A-B. As mentioned before, PID values can be fine-tuned to offer improved control and/or more consistent control for the system 10. With the addition of a hydraulic temperature feedback signal to the control system 100, an internal calculation can determine improved PID offset values for a given fluid temperature change.

As also shown in FIG. 6, the control system 100 can use an automated control throttle valve 310 (or valves as each choke could have its own throttle valve to allow for independent adjustment) in place of a manual needle valve inside the HPU 120. The valve 310 throttles the flow leading up to the chokes 160A-B. In operation, the throttle valve 310 is moved to a position that will allow the choke opening and closing speeds to be consistent throughout the range of fluid temperatures throughout the day. Generally, the throttle valve 310 can be electrically, pneumatically, or hydraulically controlled.

Operation of the automated control throttle valve 310 is tied to control feedback of ambient temperature readings in the HPU reservoir 122, in the environment, etc., such as provided by the temperature sensor 300. The fluid viscosity and accumulator pressure (which change based on temperature) may be calculated ahead of time, and the control loop may rely solely on temperature readings. Alternatively, the HPU's throttle control feedback can be tied to the choke position/time readings from the control system 100.

As further shown in FIG. 6, a heating element 320 may be added to the HPU's hydraulic reservoir 122 and/or accumulator bottle 126. Alternatively, insulation 330 can be added to surround the HPU 120, reservoir 122, accumulator bottle 126, and/or other related components. The temperature of the hydraulic fluid can be maintained using a combination of the heating and/or cooling systems 320 and insulation 330. The insulation 330 can be added or taken away for seasonal and weather temperature changes, and the heat supplied by the heating system 320 can likewise be modulated.

As will be appreciated, teachings of the present disclosure can be implemented in digital electronic circuitry, computer hardware, computer firmware, computer software, or any combination thereof. Teachings of the present disclosure can be implemented in a computer program product tangibly embodied in a machine-readable storage device for execution by a programmable processor so that the programmable processor executing program instructions can perform functions of the present disclosure. To that end, a programmable storage device having program instructions stored thereon for causing a programmable control device can perform the teachings of the present disclosure.

The teachings of the present disclosure can be implemented advantageously in one or more computer programs that are executable on a programmable system including at least one programmable processor coupled to receive data and instructions from, and to transmit data and instructions to, a data storage system, at least one input device, and at least one output device. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of drilling a wellbore with a drilling system having at least one choke, the method comprising:

controlling a parameter in the drilling system using the at least one choke by operating the at least one choke with at least one choke control value;

storing an opening speed of the at least one choke; and maintaining an opening response of the at least one choke consistent over time during operation by at least periodically performing the steps comprising:

measuring a first time for the at least one choke to at least reach a first position during an opening operation;

calculating a current opening speed of the at least one choke based on the measured first time to at least reach the first position; and adjusting the at least one choke control value for the at least one choke based on the current opening speed differing from the stored opening speed.

2. The method of claim 1, wherein the method further comprises:

storing a closing speed of the at least one choke; and maintaining a closing response of the at least one choke consistent over time operation by at least periodically performing the steps comprising:

measuring a second time for the at least one choke to at least reach a second position during a closing operation;

calculating a current closing speed of the at least one choke based on the measured second time to at least reach the second position; and adjusting the at least one choke control value for the at least one choke based on the current closing speed differing from the stored closing speed.

3. The method 1, wherein controlling the parameter in the drilling system using the at least one choke comprises at least one of: controlling surface back pressure in the wellbore; controlling flow rate of drilling fluid out of the wellbore; controlling pressure during a drillpipe connection while drilling with the drilling system; controlling pressure during a loss detected while drilling with the drilling system; and controlling flow during a kick detected while drilling with the drilling system.

4. The method of claim 1, further comprising updating the stored opening speed with the current opening speed.

5. The method of claim 1, wherein measuring the first time for the at least one choke to at least reach the first position during the opening operation comprises initiating the opening operation of the at least one choke toward a full open position.

6. The method of claim 5, wherein initiating the opening operation comprises receiving a manual or an automatic initiation of the opening operation toward the full open position.

7. The method of claim 5, wherein initiating the opening operation comprises holding a valve in a first state feeding hydraulic fluid to an actuator of the at least one choke.

8. The method of claim 1, wherein measuring the first time for the at least one choke to at least reach the first position comprises measuring the first time for the at least one choke to reach the first position of approximately 95 percent open.

9. The method of claim 1, wherein calculating the current opening speed of the at least one choke based on the measured first time to at least reach the first position comprises:

determining travel of the at least one choke from a current position to the first position; and dividing the determined travel by the first time for the current opening speed.

10. The method of claim 1, wherein adjusting the at least one choke control value for the at least one choke based on the current opening speed differing from the stored opening speed comprises determining that the current opening speed differs from the stored opening speed at least by a threshold.

11. The method of claim 1, wherein adjusting the at least one choke control value for the at least one choke based on the current opening speed differing from the stored opening speed comprises adjusting the at least one choke control value of a proportional-integral-derivative control for the at least one choke.

12. The method of claim 1, wherein the at least one choke comprises first and second chokes operable in simultaneous operation to control the parameter in the drilling system; and wherein operating the at least one choke with at least one choke control value comprises operating the first and second chokes with a same choke control or with separate choke controls.

13. The method of claim 1, wherein adjusting the at least one choke control value for the at least one choke based on the current opening speed differing from the stored opening speed comprises adjusting, for the at least one choke, at least one of a gain of a proportional-integral-derivative control, a set point, a pressure dead-band, a flow differential dead-band, and a time duration before reaction.

14. A method of drilling a wellbore with a drilling system having at least one choke, the method comprising:

controlling a parameter in the drilling system using the at least one choke by operating the at least one choke with at least one choke control value;

storing a closing speed of the at least one choke; and maintaining a closing response of the at least one choke consistent over time during operation by at least periodically performing the steps comprising:

measuring a time for the at least one choke to at least reach a first position during a closing operation;

calculating a current closing speed of the at least one choke based on the measured time to at least reach the first position; and adjusting the at least one choke control value for the at least one choke based on the current closing speed differing from the stored closing speed.

15. The method of claim 14, wherein measuring the time for the at least one choke to at least reach the first position during the closing operation comprises initiating the closing operation of the at least one choke toward a full closed position.

16. The method of claim 14, wherein measuring the time for the at least one choke to at least reach the first position comprises measuring the time for the at least one choke to reach the first position of approximately 95 percent open.

17. The method of claim 14, wherein calculating the current closing speed of the at least one choke based on the measured time to at least reach the first position comprises:

determining travel of the at least one choke from a current position to the first position; and dividing the determined travel by the first time for the current closing speed.

18. The method of claim 14, wherein adjusting the at least one choke control value for the at least one choke based on the current closing speed differing from the stored closing speed comprises determining that the current closing speed differs from the stored closing speed at least by a threshold.

19. The method of claim 14, wherein adjusting the at least one choke control value for the at least one choke based on the current closing speed differing from the stored closing speed comprises adjusting the at least one choke control value of a proportional-integral-derivative control for the at least one choke.

20. An assembly used with a drilling system for drilling a wellbore, the assembly comprising:

at least one choke operable to control a parameter in the drilling system;

at least one actuator disposed with the at least one choke and actuating operation of the at least one choke in response to supplied power; and a controller operatively coupled to the at least one actuator, the controller controlling the supplied power to the at least one actuator and controlling opening and/or closing of the at least one choke therewith, the controller configured to:

operate opening and/or closing of the at least one choke with at least one choke control value to control the parameter in the drilling system;

store an opening and/or closing speed of the at least one choke;

at least periodically perform a calibration to maintain an opening or closing response of the at least one choke consistent over time during operation, the controller in the calibration configured to:

measure a time for the at least one choke to at least reach a position during an opening and/or closing operation;

calculate a current opening/closing speed of the at least one choke based on the measured time to at least reach the position; and adjust the at least one choke control value for the at least one choke based on the current opening and/or closing speed differing from the stored opening and/or closing speed.

21. A control of at least one choke used in a drilling system for drilling a wellbore, the control comprising:

storage storing an opening and/or closing speed of the at least one choke and storing at least one choke control value for operating the at least one choke; and a programmable control device operatively coupled to the storage and to the at least one choke, the programmable control device being operable to:

operate opening and/or closing of the at least one choke with the at least one choke control value to control a parameter in the drilling system;

at least periodically perform a calibration to maintain an opening or closing response of the at least one choke consistent over time during operation, the programmable control device in the calibration configured to:

measure a time for the at least one choke to at least reach a position during an opening/closing operation;

calculate a current opening and/or closing speed of the at least one choke based on the measured time to at least reach the position; and adjust the at least one choke control value for the at least one choke based on the current opening and/or closing speed differing from the stored opening and/or closing speed.

* * * * *